US007954489B2

(12) United States Patent
Shiue

(10) Patent No.: US 7,954,489 B2
(45) Date of Patent: Jun. 7, 2011

(54) WATERPROOF STRUCTURE OF A RESPIRATORY TUBE

(75) Inventor: Chih-Cheng Shiue, Taipei (TW)

(73) Assignee: Qbas Co. Ltd. (TW)

( * ) Notice: Subject to any disclaimer, the term of this patent is extended or adjusted under 35 U.S.C. 154(b) by 824 days.

(21) Appl. No.: 11/923,979

(22) Filed: Oct. 25, 2007

(65) Prior Publication Data

US 2009/0038613 A1 Feb. 12, 2009

(30) Foreign Application Priority Data

Aug. 9, 2007 (TW) ..... 96213122 U
Sep. 28, 2007 (TW) ..... 96216223 U

(51) Int. Cl.

| | |
|---|---|
| ***B63C 11/16*** | (2006.01) |
| ***B63C 11/02*** | (2006.01) |
| ***B63C 11/10*** | (2006.01) |
| ***A62B 7/04*** | (2006.01) |
| ***A62B 18/08*** | (2006.01) |
| ***A62B 17/00*** | (2006.01) |
| ***A62B 18/10*** | (2006.01) |
| ***A61M 16/00*** | (2006.01) |

(52) U.S. Cl. ..... 128/201.11; 128/201.27; 128/204.26; 128/207.14; 128/201.26; 128/201.29; 128/201.28; 128/206.29; 405/186; 405/187

(58) Field of Classification Search ..... 128/201.11, 128/201.27, 204.26, 207.14, 201.26, 201.29, 128/201.28, 206.29; 405/186, 187
See application file for complete search history.

(56) References Cited

U.S. PATENT DOCUMENTS

| | | | | |
|---|---|---|---|---|
| 6,904,910 | B2 | 6/2005 | Christianson | |
| 7,077,127 | B2 | 7/2006 | Christianson | |
| 2004/0099264 | A1 * | 5/2004 | Christianson | 128/201.11 |
| 2008/0047552 | A1 * | 2/2008 | McCarthy | 128/201.11 |

* cited by examiner

*Primary Examiner* — Patricia M Bianco
*Assistant Examiner* — Nihir Patel
(74) *Attorney, Agent, or Firm* — Dariush G. Adli; Adli Law Group P.C.

(57) ABSTRACT

A waterproof structure of a respiratory tube is provided. The waterproof structure comprises a hollow body and a lid. The hollow body has a first opening end and a second opening end opposing to the first opening end. The lid pivots onto the hollow body at the first opening end. Before the lid is immersed into liquid, the gravity of the lid can keep the lid at a certain position so that the respiratory tube is well-ventilated. After a part of the lid is immersed into the liquid, the buoyancy provided by the liquid forces the closing surface thereof to substantially seal the first opening end and prevent liquid from going into the tube.

6 Claims, 4 Drawing Sheets

WATERPROOF STRUCTURE OF A RESPIRATORY TUBE

RELATED APPLICATIONS

This application claims priority to Taiwan Application Serial No. 096213122, filed on 9 Aug. 2007 and Taiwan Application Serial No. 096216223, filed on 28 Sep. 2007, the disclosures of which are incorporated herein by reference in their entirety.

BACKGROUND OF THE INVENTION

1. Field of the Invention

The present invention relates to a waterproof structure of a respiratory tube, and more particularly, relates to a waterproof structure of a respiratory tube used for snorkeling.

2. Descriptions of the Related Art

Respiratory tubes are essential for snorkeling. Even a beginner who cannot swim can snorkel if he or she knows how to use the respiratory tube. For this reason, manufacturers have continuously improved respiratory tubes to make them more convenient and easier to use.

The most important component of the respiratory tube is its waterproof structure. In a conventional waterproof structure, which is disposed at the end of the respiratory tube, there is a floating ball therein that functions much like an air floating bucket. When the respiratory tube is immersed into water, the floating ball will float upwards and seal the respiratory tube with the aid of a properly designed connecting rod that is connected with the floating ball. Sea water then is prevented from entering, allowing the diver to dive into the sea.

In addition, a conventional respiratory tube having a waterproof valve is disclosed in U.S. Pat. Nos. 7,077,127 and 6,904,910. The waterproof valve of the respiratory tube comprises a soft diaphragm disposed at a top opening of the respiratory tube by a linkage. When a floating device of the respiratory tube is immersed into water, it will drive the linkage to indirectly move the diaphragm against the opening of the respiratory tube thereby preventing water entry. On the contrary, when the floating device of the respiratory tube departs from water, it will drive the linkage to indirectly move the diaphragm apart the opening.

Unfortunately, this conventional waterproof structure requires a complex assembly process and increases the manufacturing cost because of the relatively large number of components. Furthermore, when using the conventional respiratory tube, sometimes the waterproof structure closes prematurely even before the diver dives into the water, or is prone to water entry, thus preventing the respiratory tube from functioning properly.

Therefore, it is important to design a simplified waterproof structure that can function properly at all times without it being too costly.

SUMMARY OF THE INVENTION

One objective of this invention is to provide a waterproof structure of a respiratory tube, which can seal or open the respiratory tube depending on the buoyancy provided by the liquid and the gravity of the waterproof structure itself.

Another objective of this invention is to provide a waterproof structure of the respiratory tube, which can either be formed integrally or by joining individual components together, thus eliminating a complex assembly process as used in the prior art and reducing the manufacturing costs thereof.

Yet a further objective of this invention is to provide a waterproof structure of a respiratory tube, which is designed in such a manner that its own lid will automatically shut without any external driving force, thus improving the waterproof efficacy of the respiratory tube.

To this end, a waterproof structure of a respiratory tube disclosed in this invention comprises a hollow body and a lid. The hollow body comprises two opening ends opposite to each other. The lid is pivoted onto the hollow body at the first opening end and is adapted to rotate about the pivot. When the lid is not immersed into the liquid, a fluid communication will be formed between the two opening ends by gravity. On the contrary, when part of the lid is immersed in the liquid, the lid will close the first opening end of the tube due to the buoyancy provided by the liquid to prevent liquid entry.

The detailed technology and preferred embodiments implemented for the subject invention are described in the following paragraphs accompanying the appended drawings for the people skilled in this field to well appreciate the features of the claimed invention.

DESCRIPTION OF THE PREFERRED EMBODIMENT

Figure 1A:
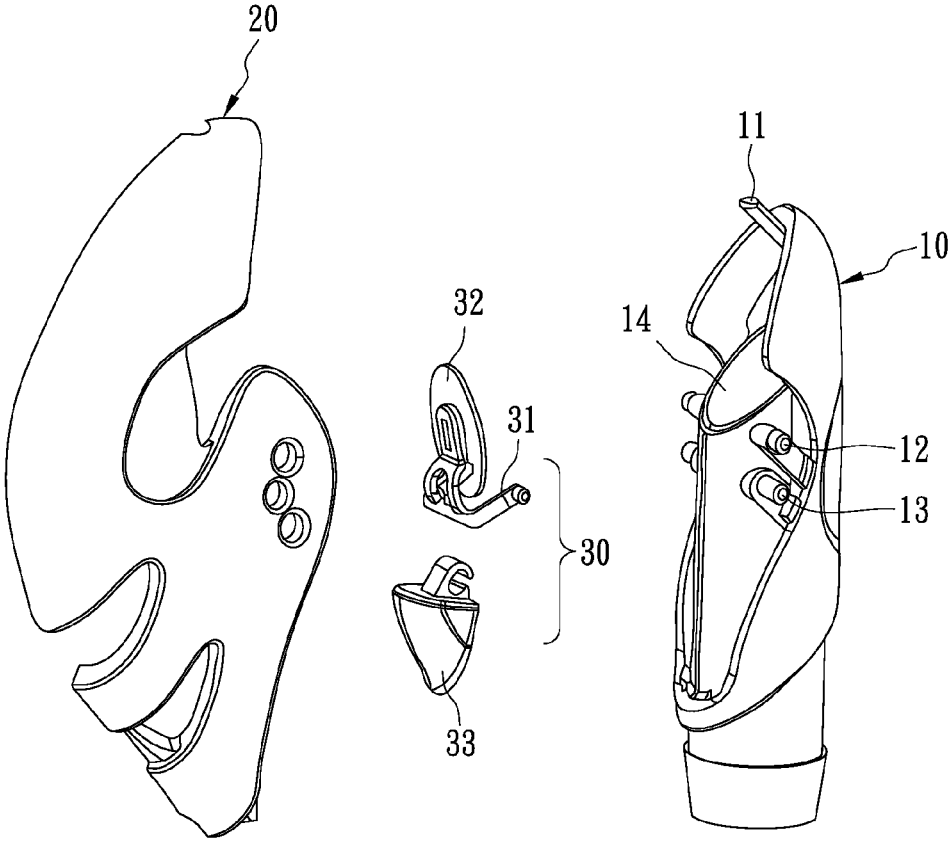
FIG. 1A(prior art)
FIG. 1A is a schematic perspective view of the components of a conventional waterproof structure.
Figure 1B:
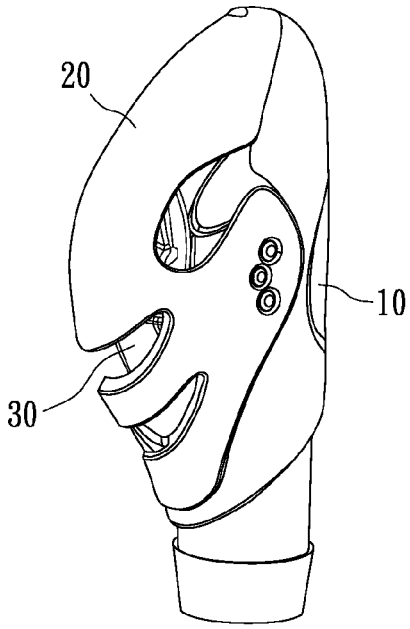
FIG. 1B(prior art)
FIG. 1B is a schematic perspective view of the conventional waterproof structure.

FIGS. 1A and 1B illustrate a conventional respiratory tube having a waterproof structure which mainly comprises a main body 10 and a cover 20, with a blocking device 30 disposed inside the cover 20. The main body 10 is shaped into a hollow tube with a hollow opening 14 which may be extended to the opening of the said respiratory tube. A plurality of fasteners 11, 12 and 13 are provided on the main body 10 for connection with the cover 20. The cover 20 is shaped like a bowl and has the blocking device 30 therein. The blocking device 30 comprises a directional moving rod 31 disposed through the axial hole of the cover 20, a cap 32 disposed above the directional moving rod 31 and a floating element 33 hooked below the directional moving rod 31. When the floating element 33 floats upwards due to the buoyancy provided by the liquid, it will drive the directional moving rod 31, so that the cap 32 will seal the opening 14.

Figure 2A:
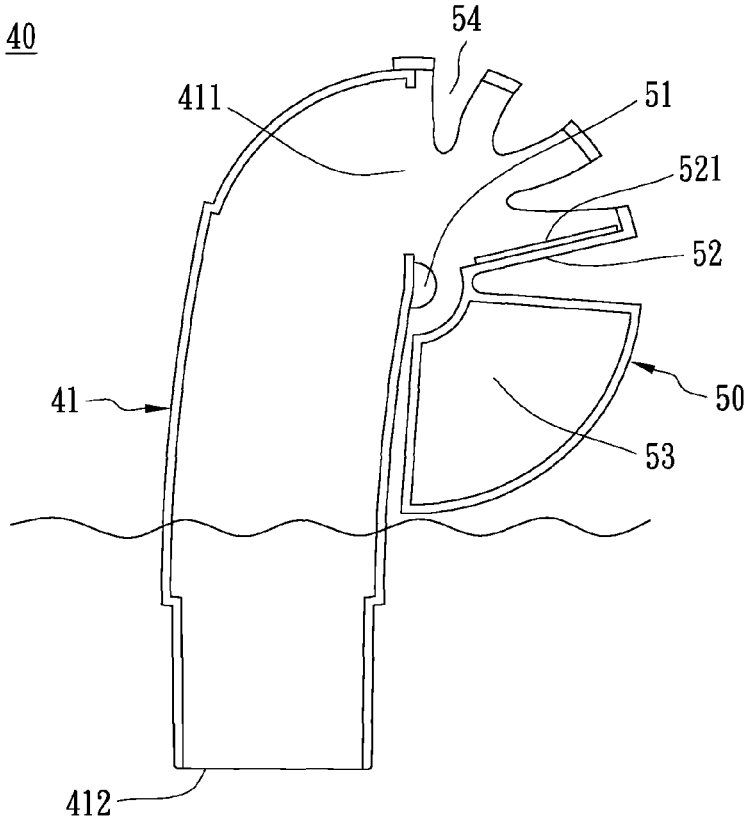
FIG. 2A is a schematic cross-sectional view of the waterproof structure of the present invention when the lid is not immersed in the fluid.
Figure 2B:
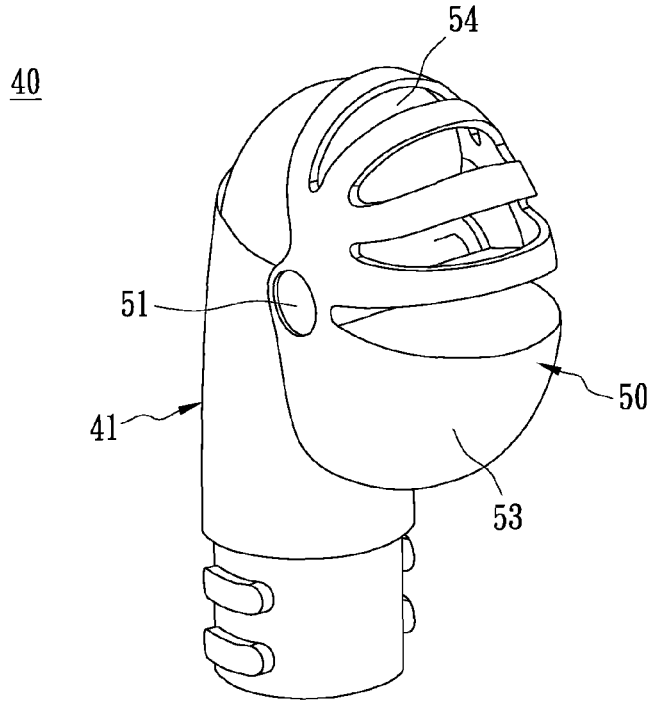
FIG. 2B is a schematic perspective view of the waterproof structure of the present invention when the lid is not immersed in the fluid.

FIG. 2B is a schematic perspective view of a waterproof structure 40 in accordance with one preferred embodiment of this invention, while FIG. 2A is a schematic cross-sectional view of the waterproof structure 40 as shown in FIG. 2B. The waterproof structure 40 comprises a hollow body 41 and a lid 50. The waterproof structure is formed integrally or by assembling major components together. A complex assembly process as used in the prior art is thus eliminated, as well as the high manufacturing costs.

The hollow body 41 has a first opening end 411 and a second opening end 412 opposite to the first opening end 411. The first opening end 411 is disposed at the upper end of the hollow body 41 to form a fluid communication between the hollow body 41 and the atmosphere. The second opening end 412 is disposed at the lower end of the hollow body 41 for connection with the respiratory tube.

The lid 50 comprises a pivot 51, a closing surface 52, an enclosed chamber 53 and a venting aperture 54. In particular, the pivot 51 of the lid 50 is disposed at the first opening end 411 of the hollow body 41 to allow the lid 50 to rotate about the pivot 51. In addition, the contour of the closing surface 52 is adapted to match the first opening end 411, so that it can seal the first opening end 411 of the hollow body 41 to prevent liquid from entering the respiratory tube via the first opening end 411. In this embodiment, the closing surface 52 is a part of the lid 50. Alternatively, in another embodiment, the closing surface 52 is adapted to define a sidewall of the enclosed chamber 53, of which the sidewall faces the first opening end 411. Those of ordinary skill in the art can change the position of the closing surface 52, which is not limited herein.

Additionally, the overall density of the enclosed chamber 53 is less than that of the liquid, so when the enclosed chamber 53 is immersed into the liquid, the buoyancy provided by the liquid will drive the lid 50 to rotate about the pivot 51 to seal the first opening end 411 of the hollow body 41. When the lid 50 is not immersed into the liquid, or when only part of the lid 50 is immersed into the liquid with the lid 50 still separated from the first opening end 411 of the hollow body 41, the atmospheric air outside the first opening end 411 will ventilate within the hollow body 41 via the venting aperture 54 and further flow into the respiratory tube via the second opening end 412.

Figure 3A:
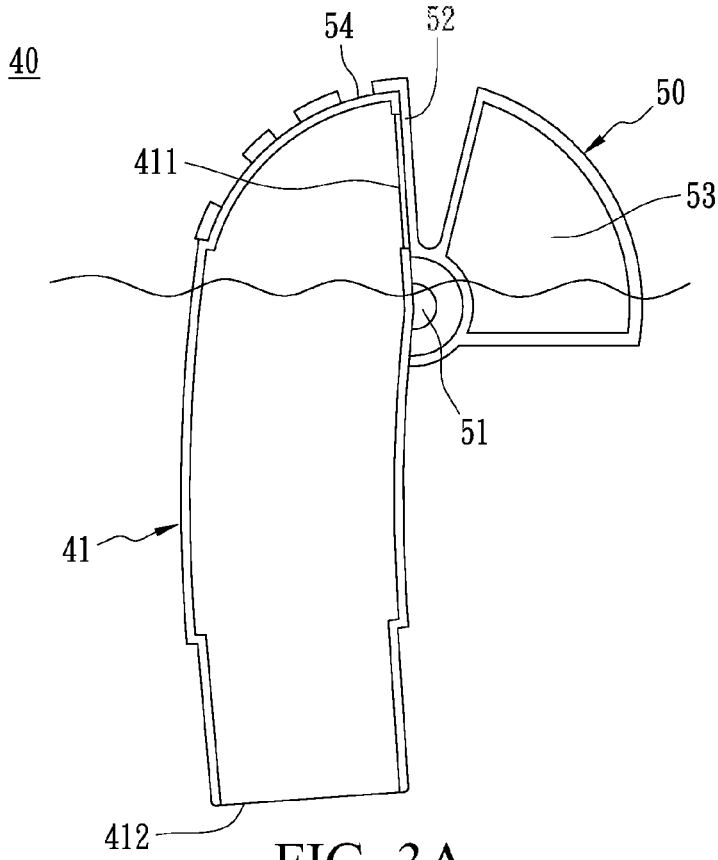
FIG. 3A is a schematic cross-sectional view of the waterproof structure of the present invention when the lid is immersed in the fluid.

FIGS. 2A and 3A illustrate the properties of the waterproof structure 40. As the lid 50 of the waterproof structure 40 of this invention is pivoted between the first and second positions, a portion thereof can move along the contour of the hollow body 41 to allow the waterproof structure 40 to function smoothly. In particular, as shown in FIG. 2A, when the lid 50 has not yet been immersed into the liquid, the lid 50 tends to stay at the first position due to its own gravity, so that a fluid connection is formed between the atmosphere and the respiratory tube via the first opening end 411 and second opening end 412. As a result, the diver can breathe. On the other hand, when the enclosed chamber 53 of the lid 50 is partially immersed in the liquid, the lid 50 is adapted to rotate about the pivot 51 to the second position and stay there due to the buoyancy provided by the liquid to the closed chamber 53, so that the closing surface 52 seals the first opening end 411 as shown in FIG. 3A.

Figure 3B:
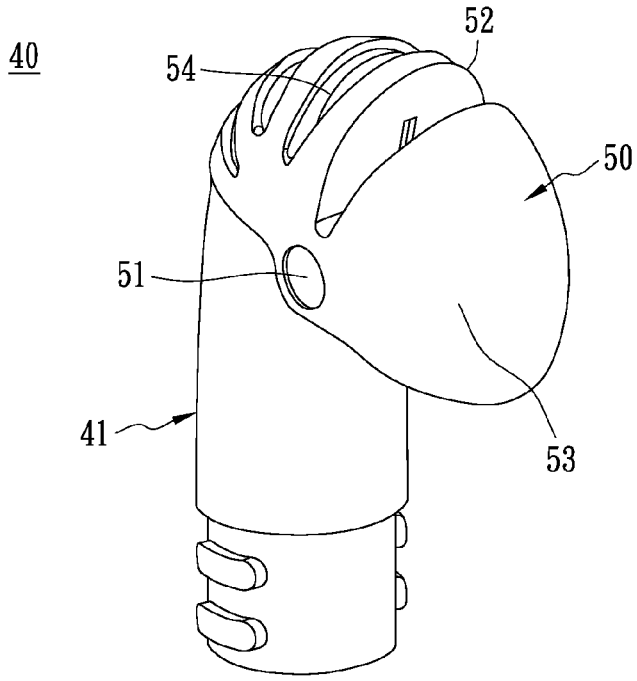
FIG. 3B is a schematic perspective view of the waterproof structure of the present invention when the lid is immersed in the fluid.

For example, when the lid 50 of the waterproof structure 40 is immersed in sea water with a density ranging substantially from 1.02 g/cm$^3$ to 1.07 g/cm$^3$, the overall density of the closed chamber 53 of this invention is less than that of the sea water. As a result, the closed chamber 53 will float on the sea water due to the buoyancy, causing the lid 50 to rotate so that the closing surface 52 can seal the first opening end 411, as shown in FIG. 3B. In contrast, when the lid 50 of the waterproof structure 40 of this invention leaves sea level, the enclosed chamber 53 will, by gravity, drive the closing surface 52 to depart from the first opening end 411. The atmospheric air will then flow into the two opening ends 411 and 412 of the hollow body 41 of the waterproof structure 40 via the venting aperture 54. Consequently, ventilation is formed through the respiratory tube, thereby allowing the divers to breathe.

Figure 4:
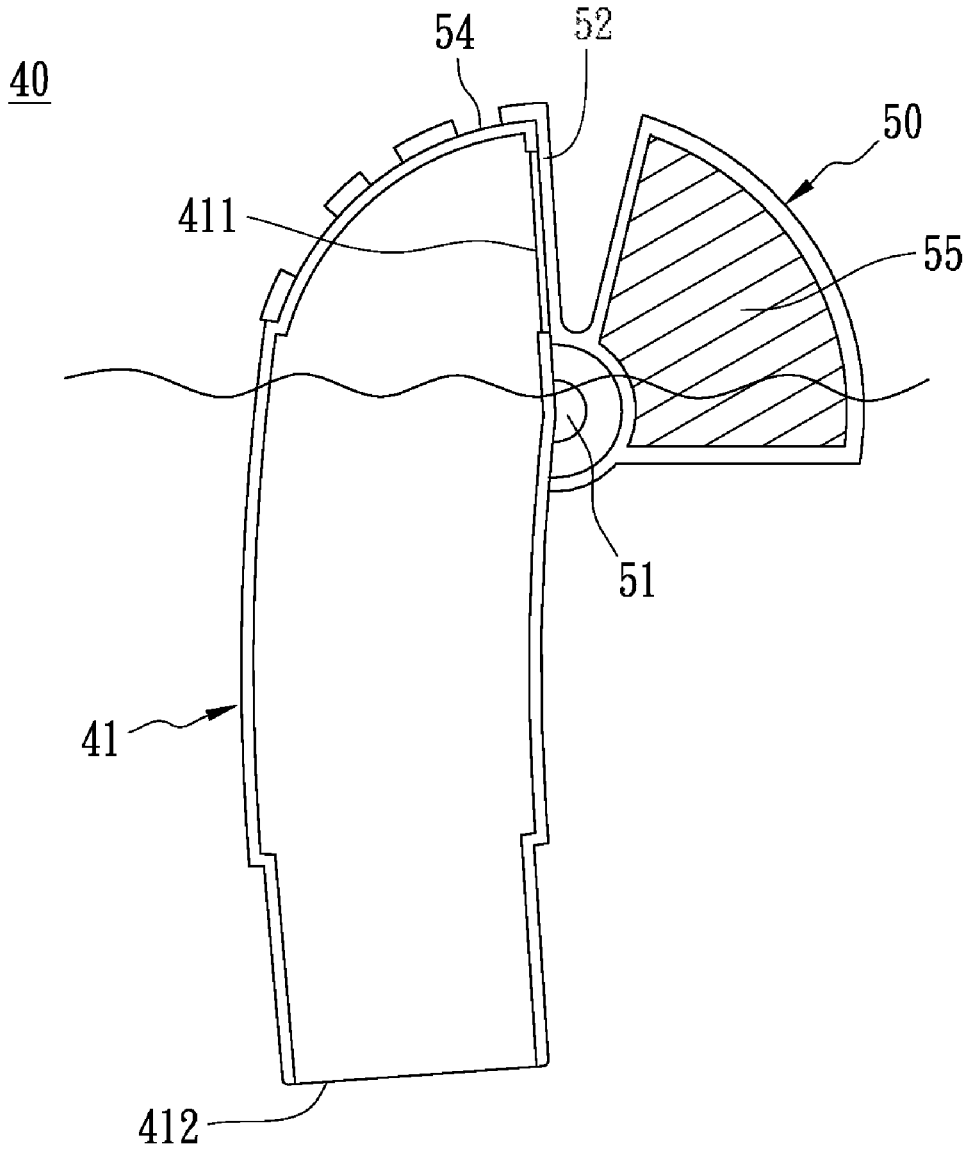
FIG. 4 is a schematic cross-sectional view of the waterproof structure when the lid is immersed in the fluid in another embodiment of the present invention.

In another preferred embodiment of the invention, the lid 50 of the waterproof structure 40 comprises a floating element 55, as shown in FIG. 4. In this embodiment, the material of the floating element 55 has density lower than the liquid. For example, the material of the floating element 55 has density less than 1.02 g/cm$^3$ when it is used in the sea water. The material of the floating element 55 can be selected from wood, foam or the combination thereof. Those of ordinary skill in the art can use other materials having lower density, which are not limited herein. Besides, the structure of the floating element 55 is not limited to the closed structure, which depends on the design. In this embodiment, the closing surface 52 is a part of the lid 50. Alternatively, the closing surface 52 is adapted to define the sidewall of the floating element 55, of which the sidewall faces the first opening end 411.

When the floating element 55 is partially immersed into the liquid, the buoyancy provided by the liquid will drive the lid 50 to rotate to seal the first opening end 411 thereby preventing liquid entry. When the floating element 55 departs from the liquid, the floating object 50 will, by gravity, drive the closing surface 52 to depart from the first opening end 411, so that the atmospheric air outside will ventilate within the hollow body 41 of the waterproof structure 40.

In addition, in the preferred embodiment of this invention, a sealing element 521 may be further disposed at the closing surface 52 of the waterproof structure 40, as shown in FIG. 2A, so that the closing surface 52 can tightly seal the first opening end 411. However, this embodiment is only one example, and those of ordinary skill in the art will appreciate that, the sealing element 521, such as a ring (not shown), may be alternatively disposed at the first opening end 411 to make the closing surface 52 seal the first opening end 411 tightly.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A waterproof structure of a respiratory tube for snorkeling in liquid, comprising:

a hollow body having a first opening end and a second opening end opposing to the first opening end; and a lid having a closing surface and a chamber, the lid pivoted onto the hollow body at the first opening end and being adapted to rotate from a first position to a second position;

wherein the lid is adapted to stay at the first position by gravity thereof to form a fluid communication between the first opening end and the second opening end through the hollow body, whereas the lid is adapted to stay at the second position by buoyancy of the chamber when the chamber is partially immersed into the liquid with the closing surface thereof being sealed with the first opening end.

2. The waterproof structure as claimed in claim 1, wherein the second opening end of the respiratory tube is immersed into the liquid.

3. The waterproof structure as claimed in claim 1, wherein the closing surface is adapted to define a sidewall of the chamber, of which the sidewall faces the first opening end.

4. The waterproof structure as claimed in claim 1, wherein the lid further comprises at least one venting aperture to form a ventilation between the first opening end and the second opening end through the at least one venting aperture when the closing surface departs the first opening end.

5. The waterproof structure as claimed in claim 1, wherein the lid is adapted to move along a contour of the hollow body when the lid pivots between the first position and the second position.

6. The waterproof structure as claimed in claim 1, further comprising a sealing element disposed on at least one of the first opening end and the closing surface.

* * * * *